United States Patent [19]

Tassie

[11] 4,434,699

[45] Mar. 6, 1984

[54] AMMUNITION FEEDER

[75] Inventor: Douglas P. Tassie, St. George, Vt.

[73] Assignee: General Electric Company, Burlington, Vt.

[21] Appl. No.: 311,585

[22] Filed: Oct. 15, 1981

Related U.S. Application Data

[63] Continuation of Ser. No. 91,329, Nov. 5, 1979, abandoned.

[51] Int. Cl.[3] ..... F41D 10/30; F41D 10/32

[52] U.S. Cl. ..... 89/12; 89/33 CA; 89/33 SF

[58] Field of Search ..... 89/12, 33 BC, 33 CA, 89/33 SF

[56] References Cited

U.S. PATENT DOCUMENTS

| | | | |
|---|---|---|---|
| 2,815,699 | 12/1957 | Davis | 89/33 CA |
| 2,849,921 | 9/1958 | Otto | 89/12 |
| 3,101,647 | 8/1963 | Greene | 89/33 SF |
| 3,319,524 | 5/1967 | Tassie | 89/33 CA |
| 3,333,506 | 8/1967 | Henshaw et al. | 89/33 CA |
| 3,367,236 | 2/1968 | Menneking | 89/33 SF |
| 3,380,342 | 4/1968 | Chiabrandy | 89/12 |
| 3,380,343 | 4/1968 | Chiabrandy et al. | 89/12 |
| 3,429,221 | 2/1969 | Kirkpatrick | 89/33 BA |
| 3,662,646 | 5/1972 | O'Brien et al. | 89/33 SF |
| 3,670,863 | 6/1972 | Meier et al. | 89/33 BC |
| 3,995,527 | 12/1976 | Schiele et al. | 89/33 SF |
| 4,015,511 | 4/1977 | Folsom et al. | 89/33 SF |
| 4,114,511 | 9/1978 | Patenaude | 89/33 CA |

OTHER PUBLICATIONS

General Electric, The GAU-8/A 30-MM Gun, MPB906, (1500), 480.

General Electric, .50 Caliber Gatling Gun, 024-516A, (9/69).

*Primary Examiner*—Stephen C. Bentley

*Attorney, Agent, or Firm*—Bailin L. Kuch

[57] ABSTRACT

A feature of this invention is the provision of sprocket which feeds rounds into the gun via an intermediate sprocket and which receives cases from the gun via another intermediate sprocket, and which may be intercoupled with either of two endless conveyors of ammunition.

16 Claims, 9 Drawing Figures

FIG. 5
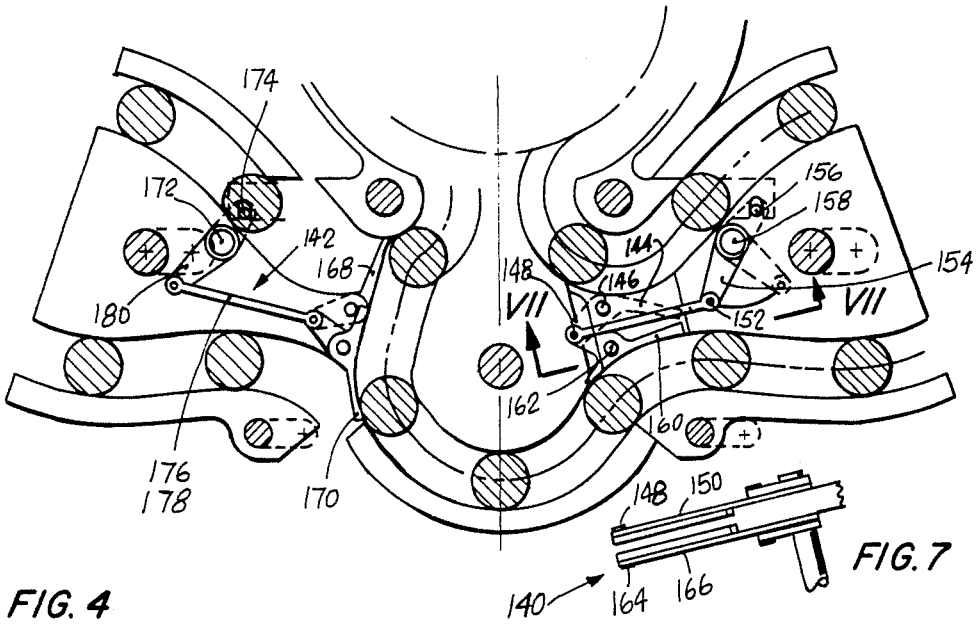
FIG. 7
FIG. 4
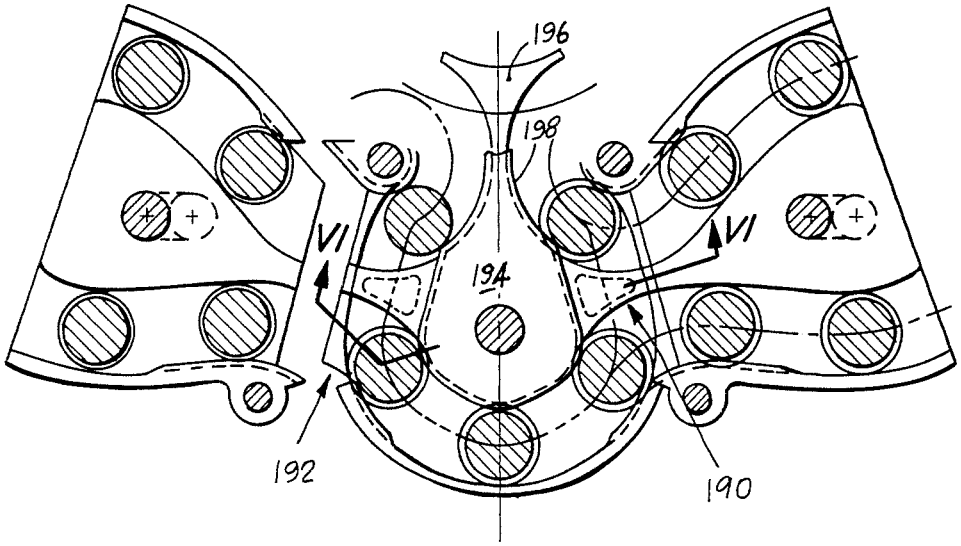

AMMUNITION FEEDER

This is a continuation of Ser. No. 091,329, filed Nov. 5, 1979 now abandoned.

BACKGROUND OF THE INVENTION

1. Field of the Invention

This invention relates to a feeder for providing either of two independent supplies of ammunition to a Gatling type gun.

2. Description of the Prior Art

Selectable dual feeders of ammunition, in combination with a single barrel gun, which permit the gunner to select, between bursts of fire, either of two feeds of ammunition, are well known. Such feeders are shown, for example, in U.S. Pat. No. 3,662,646, issued May 16, 1972, to J. F. O'Brien et al and U.S. Pat. No. 4,015,511, issued Apr. 5, 1977, to L. R. Folsom et al. While these feeders are well suited for use with guns having but one barrel, they are not suited for use with guns having a plurality of barrels rotating about a common axis, such as a Gatling type gun.

BRIEF SUMMARY OF THE INVENTION

Accordingly, it is an object of this invention to provide a feeder for a Gatling type gun which permits the gunner to select, between bursts of fire, either of two feeds of ammunition.

It is another object to provide such a feeder wherein after a change in selection is made, the first round fired is of the new selection.

It is still another object to provide such a feeder which accommodates reverse clearing of the gun after completion of each burst of fire.

A feature of this invention is the provision a of sprocket which feeds rounds into the gun via an intermediate sprocket and which receives cases from the gun via another intermediate sprocket, and which may be intercoupled with either of two endless conveyors of ammunition.

BRIEF DESCRIPTION OF THE DRAWING

These and other objects, advantages and features of the invention will be apparent from the following specification thereof taken in conjunction with the accompanying drawing in which:

FIG. 4 is a detail of FIG. 2 showing the switching of the aft guides for the bases of the rounds;

FIG. 5 is a detail of FIG. 2 showing the switching of the forward guides for the necks of the rounds;

FIG. 7 is a crosssection of FIG. 5 taken at VII—VII; and

DESCRIPTION OF THE INVENTION

Figure 1:
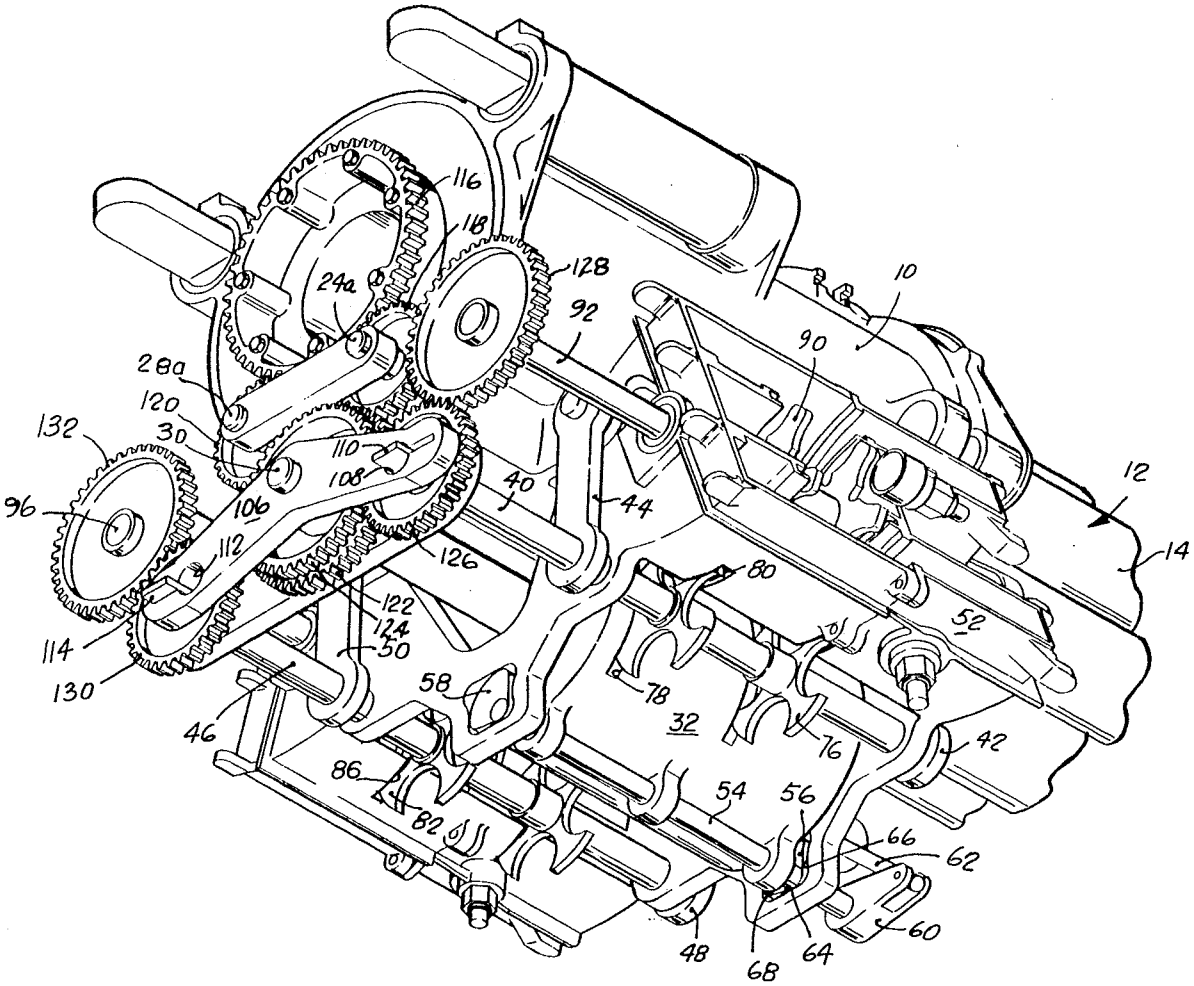
FIG. 1 is a perspective view of a feeder, in conjunction with a Gatling type gun, embodying this invention.

The Gatling type gun may be of the type shown, for example, by R. E. Chiabrandy et al in U.S. Pat. No. 3,380,343, issued Apr. 30, 1968. The gun includes a gun housing 10 in which is journaled a rotor 12 having seven gun barrels 14, each barrel having a respective bore, and seven channels 16, each having a pair of tracks 18 to receive a respective gun bolt 20. The gun housing is cut away to clear a right load sprocket 22 having three pockets in each of three blades which are fixed on a right shaft system 24*a* and 24*b* and a left unload sprocket 26 having three pockets in each of three blades which are fixed on a left shaft system 28*a* and 28*b*.

The shaft systems 24*a* and 24*b* and 28*a* and 28*b*, together with a center shaft 30, are journaled in a feeder housing 32 which is fixed to the gun housing 10. A center sprocket 34 having five pockets in each of two blades is fixed on the shaft 30.

A right shaft 40 is hung from and journaled in a front right link 42 and an aft right link 44, which links are pivotally mounted to the fixed feeder housing 32. A left shaft 46 is hung from and journaled in a front left link 48 and an aft left link 50, which links are pivotally mounted to the fixed feeder housing 32.

A shiftable feeder housing 52 is suspended from the shafts 40 and 46 which are journaled therein. A control rod 54 is journaled in the fixed feeder housing 32 and has a front cam 56 and an aft cam 58, a switch lever 60 and a push rod 62. Each of the cams 56 and 58 is disposed within a respective aperture in the shiftable housing 52. The front aperture 64 has a right cam follower surface 66 and a left cam follower surface 68. The aft aperture 70 has a right cam follower surface 72 and a left cam follower surface 74. A pull on the rod 62 causes counterclockwise rotation of the control rod 54 and a shift to the left of the shiftable housing 52 with respect to the fixed housing 32. A push causes clockwise rotation and a shift to the right.

A right transfer sprocket 76 is fixed to the right shaft 40 and has four pockets in each of two blades which pass through cutouts 78 in the fixed housing 32 and cutouts 80 in the shiftable housing 52. A left transfer sprocket 82 is fixed to the left shaft 46 and has four pockets in each of two blades which pass through cutouts in the fixed housing and cutouts 86 in the shiftable housing.

A right conveyor turnaround sprocket 90 is fixed to a right shaft 92 which is journaled through the shiftable housing 52, and has five pockets in each of two blades. A left conveyor turnaround sprocket 94 is fixed to a left shaft 96 which is journaled through the shiftable housing 52, and has five pockets in each of two blades. A right endless conveyor 98 including a train of conveyor elements 100, as shown, for example, in U.S. Pat. No. 3,429,211, issued to R. G. Kirkpatrick on Feb. 25, 1969, is disposed in the shiftable housing and incorporates the right turnaround sprocket 90, the right load sprocket 22, and the right transfer sprocket 76. A similar left endless conveyor 102, including a train of conveyor elements 104, incorporates the left turnaround sprocket 94, the left unload sprocket 26 and the left transfer sprocket 82.

A timing bar 106 is pivotally mounted on the center shaft 30. The bar has a right keyhole cutout 108 receiving the flattened end 110 of the right transfer sprocket shaft 40, and a left keyhole cutout 112 receiving the flattened end 114 of the left transfer sprocket shaft 46. When a flattened end is in the circular part of the keyhole cutout the shaft is free to rotate, when the flattened end is shifted into the slot of the keyhole cutout the shaft is held against rotation.

An annular gear 116 is fixed to the gun rotor 12 and is meshed with a right gear 118 which is fixed to the right shaft 24*a*, which is geared to the load sprocket 22 via a gear 119*a* fixed to a parallel shaft 119*b* also having fixed thereto a gear 119*c*, which in turn is meshed with a gear 119*d* which is fixed to the shaft 24*b*. A gear 118 is meshed with a left gear 120 which is fixed to the left shaft system 28*a* and 28*b* and carries the sprocket 26 similar to the shaft system 24*a* and 24*b*. A gear 122 and a gear 124 are fixed to the center sprocket shaft 30. The gear 122 is meshed with the right gear 118 and the left gear 120. A right gear 126 is fixed to the right transfer sprocket shaft 40 and is meshed with a right gear 128 which is fixed to the right turnaround sprocket shaft 92. A left gear 130 is fixed to the left transfer sprocket shaft 46 and is meshed with a left gear 132 which is fixed to the left turnaround sprocket shaft 96. When the right transfer sprocket shaft 40 is swung to the left, it is free to rotate and its gear 126 is meshed with the gear 124, while the left gear 130 is out of mesh and locked. When the left transfer sprocket shaft 46 is swung to the right, it is free to rotate and its gear 130 is meshed with the gear 124, while the right gear 126 is out of mesh and locked.

When the shiftable feeder housing 52 is shifted to the left, as shown in the FIGS., the right endless conveyor 98 is engaged for feeding rounds into the gun, and the left endless conveyor 102 is disengaged; and vice versa.

A forward right guide assembly 140 and a forward left guide assembly 142 are provided, as shown in FIGS. 5 and 7, to guide the necks of the cartridge cases. A right upper guide 144 is mounted by a medial pivot 146 to the shiftable feeder housing 52 and its tail is coupled by a pivot 148 to one end of a link 150 whose other end is coupled by a pivot 152 to the distal end of crank arm 154 whose proximal end is mounted by a pivot 156 to the fixed housing 32 but is medially mounted by a pivot 158 to the shiftable housing 52. Similarly, a right lower guide 160 is mounted by a medial pivot 162 to the shiftable housing 52 and its tail is coupled by a pivot 164 to one end of a link 166 whose other end is also coupled to the pivot 152. A left upper guide 168 and a left lower guide 170 are similarly pivotally mounted to the shiftable feeder at 172 and 174 respectively, and their tails are coupled to respective links 176 and 178 which are coupled to a crank arm 180. When the shiftable feeder is shifted to the left, as shown in FIG. 5, the right guides 144 and 160 are toggled backwards to clear access of the right conveyor assembly 98 to the center sprocket 34, while the left guides 168 and 170 are toggled erect to define a boundary around the center sprocket 34; and vice versa.

Figure 6A:
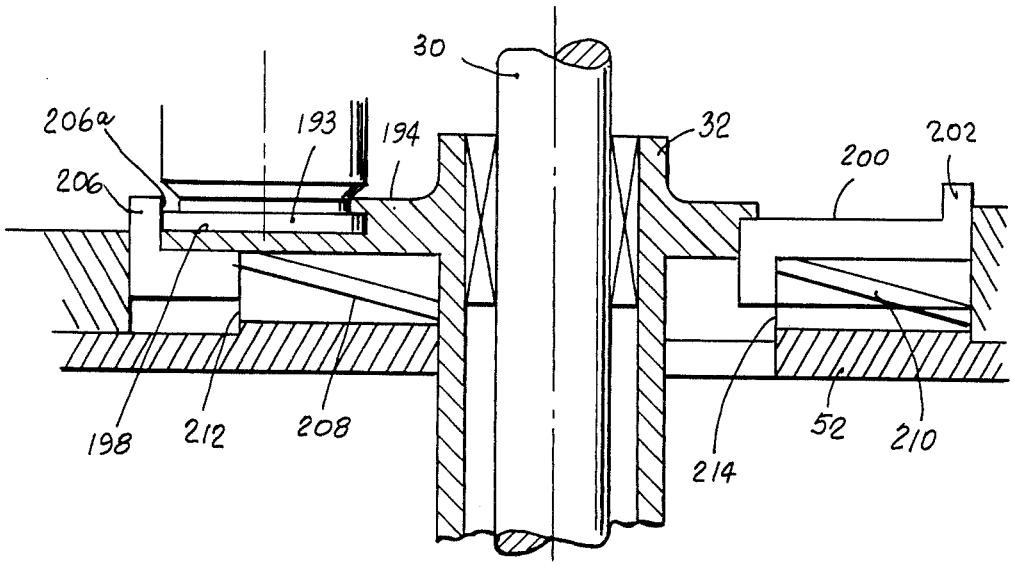
FIGS. 6A and 6B are crosssections of FIG. 4 taken at VI–VI.
Figure 6B:
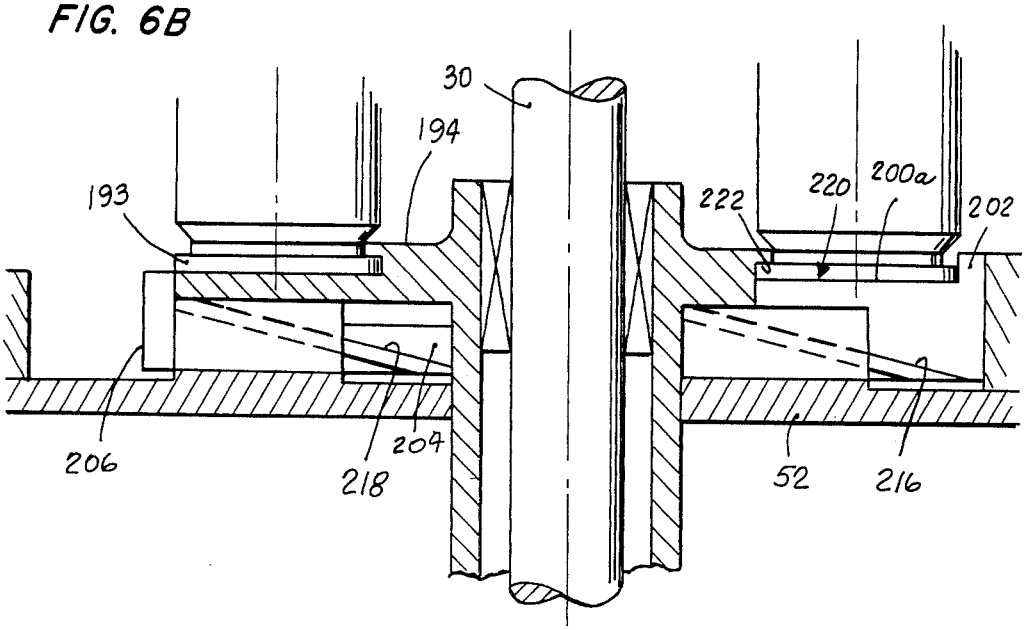
Figure 8:
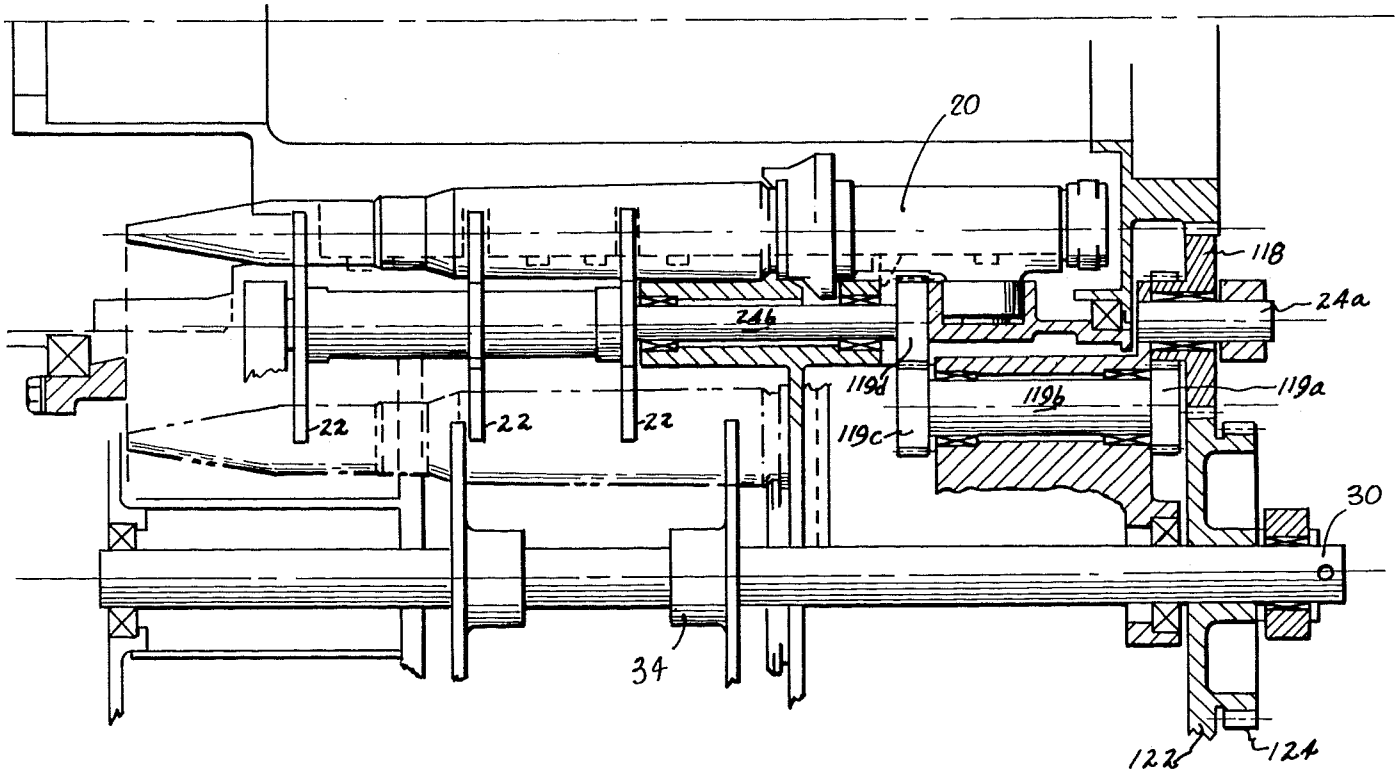
FIG. 8 is a longitudinal crosssection of the feeder of FIG. 1 showing the drive for the sprocket.

An aft right guide assembly 190 and an aft left guide assembly 192 are provided, as shown in FIGS. 4, 6A and 6B, to guide the bases, i.e., the extractor disks 193, of the cartridge cases. The fixed feeder housing 32 includes a central plate 194 which extends into an inner guide bar portion 196 which projects into an annular slot cut into the gun rotor 12. Such guide bars and slots are shown, for example, in U.S. Pat. No. 3,380,342, issued to R. E. Chiabrandy on Apr. 30, 1968. A groove 198 is cut into the central plate 194 to receive the rim of the extractor disk. A right inner guide 200, a right outer guide 202, a left inner guide 204 and a left outer guide 206 are coupled to and controlled by the transverse movement of the shiftable feeder housing 52 with respect to the fixed feeder housing 32 to longitudinally move fore and aft into and out of alignment with the disk receiving groove 198. The right inner guide 200 and the left outer guide 206 are integral and are concurrently shifted longitudinally by means of two sloping cam slots 208 and 210 cut in two longitudinally extending projections 212 and 214 on the shiftable housing 52 in which respectively ride two sloping cam rails 216 and 218 respectively projecting from the guides 200 and 206. The forward or extended position of the guides 200 and 206 is shown in FIG. 6A. The right inner guide 200 provides a margin 200*a* on which the periphery of the extractor disk can ride as it comes out of the groove 198. The left outer guide 206 provides a side surface 206*a* which blocks the extractor disk from leaving the groove 198. The aft or retracted position of the guides 200 and 206 is shown in FIG. 6B. The right inner guide provides a void 220 including a groove 222, which groove is actually a portion of the groove 198, which the extractor disk can pass while the disk is constrained to ride in the groove 198 by the right outer guide 202. The left outer guide 206 has retracted its surface 206*a* and provides clearance for the extractor disk as it is guided by the left inner guide 204 out of the groove 198.

Figure 2:
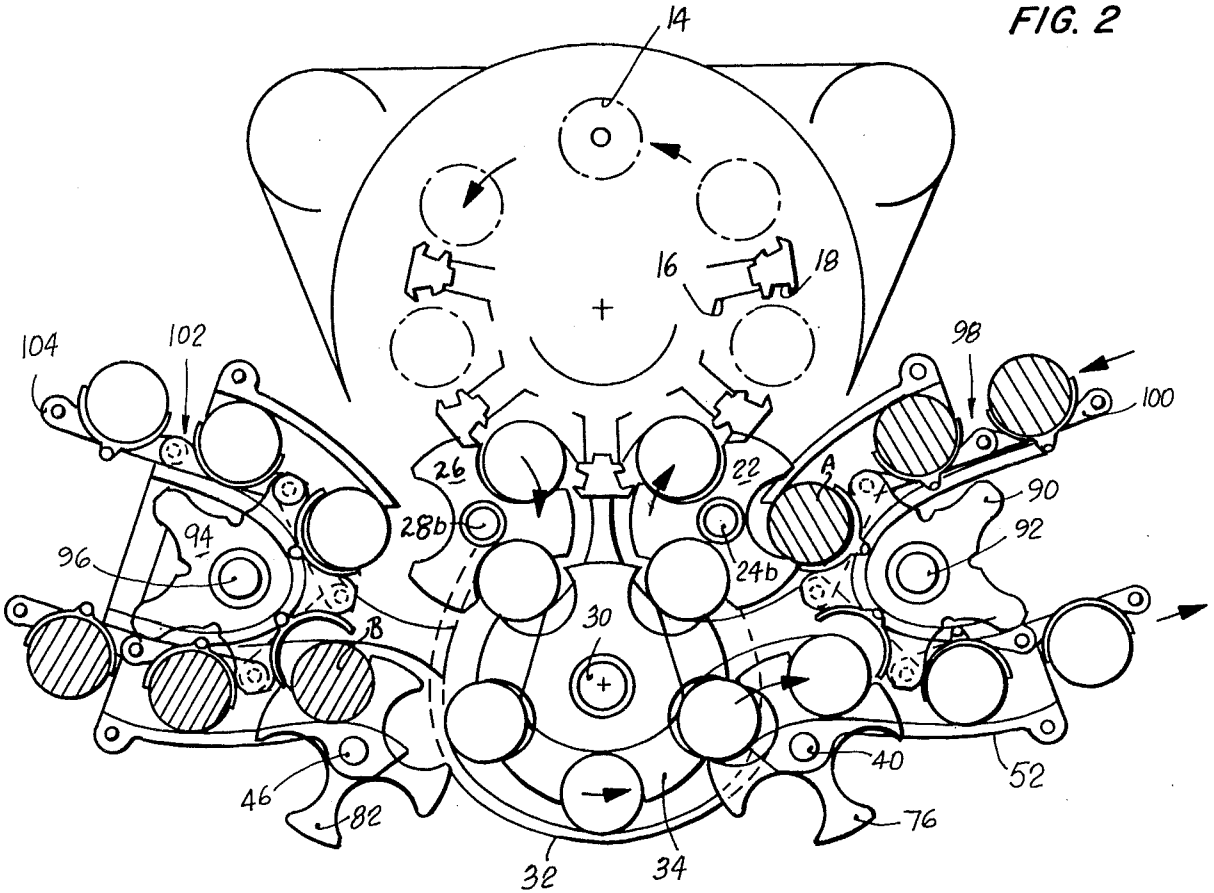
FIG. 2 is a transverse schematic, looking forward, of the feeder of FIG. 1.
Figure 3:
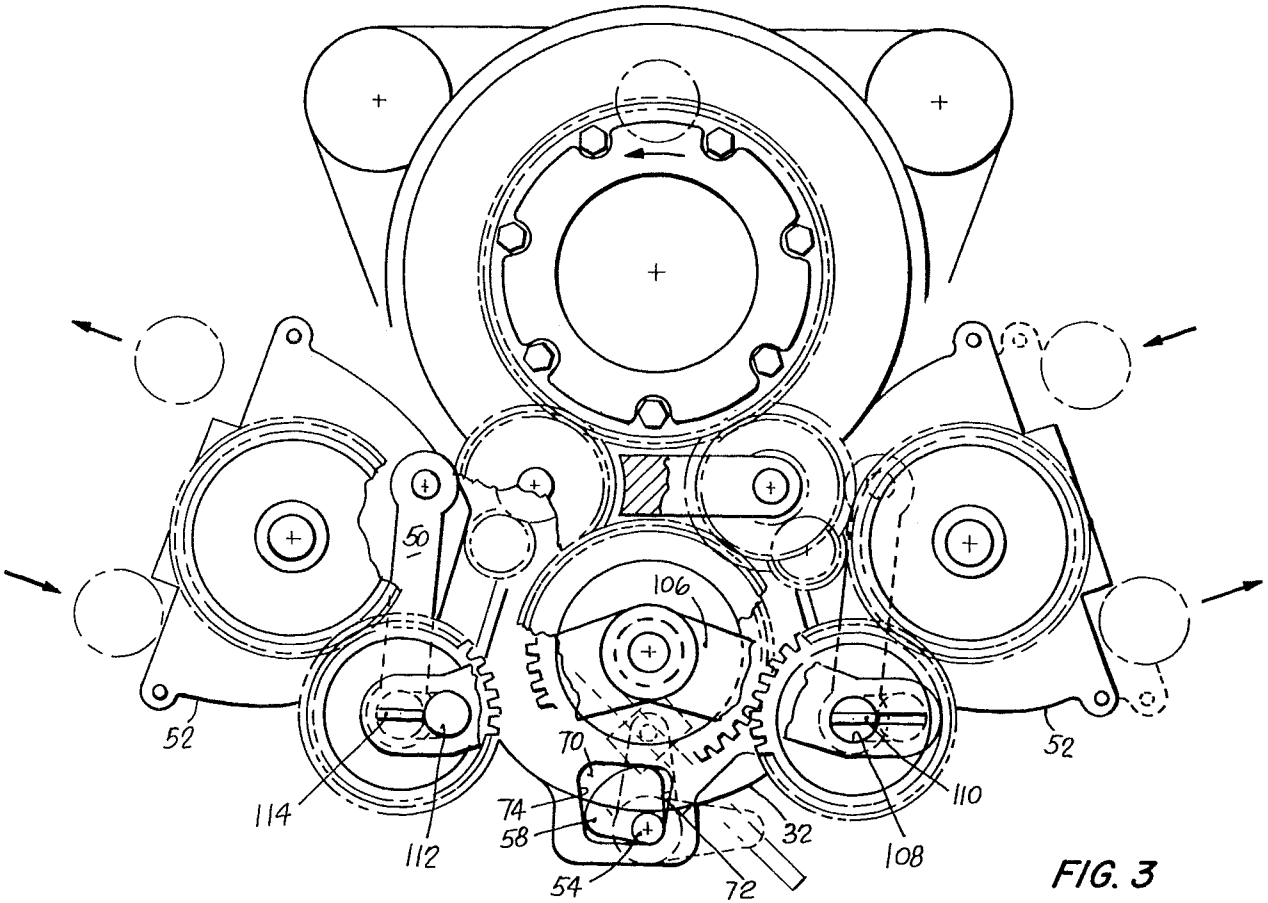
FIG. 3 is an end schematic, looking forward, of the feeder of FIG. 1.

The gun may be of the type that rotates in only one direction, e.g., counterclockwise, but preferably it is of the type which at the end of a firing burst, reverses its direction of rotation and that of its feed system to clear the gun of unfired rounds by transferring them back through the feed system. Such a gun is exemplified by the GAU-8/A. As seen in FIG. 2, the gun fires in the counterclockwise direction and reverse-clears in the clockwise direction.

With the right endless conveyor 98 engaged, and the left endless conveyor 102 disengaged, the right conveyor turnaround sprocket 90 rotates counterclockwise to hand off rounds of ammunition from the right conveyor elements 100 into the right load sprocket 22 which engages them with the center sprocket 34 and hands them off to the respective gun bolts in the rotor. The rounds are fired and continue around until they are taken off by the unload sprocket 26 which engages them with the center sprocket 34. The rounds, i.e., the fired cases, continue around with the center sprocket which hands them off to the right transfer sprocket 76 which in turn hands them off to the right conveyor elements 100 as they pass the right turnaround sprocket 90. When the gun reverse-clears, the direction of the rotor, the center sprocket and the right endless conveyor is reversed, and the rounds are taken off by the load sprocket 22 which in turn hands them off to the right conveyor elements as they pass the right turnaround sprocket. The reverse clearing continues until the last live round A is past the load sprocket and in its conveyor element. During reverse clearing fired cases have been handed in by the right conveyor elements to the transfer sprocket 76 which in turn has handed them into the center sprocket 34. Should the right endless conveyor 98 now be disengaged, it will take all of the live rounds with it. When the right endless conveyor 98 is next engaged, or if not previously disengaged, when the gun is next fired, the last live round A will be the initial round to be handed into the load sprocket 22 for firing.

With the left endless conveyor 102 engaged, and the right endless conveyor 98 disengaged, the left conveyor turnaround sprocket 94 rotates counterclockwise to hand off rounds of ammunition from the left conveyor elements 104 into the left transfer sprocket 82 which in turn hands them off to the center sprocket which carries them around and in turn hands them off to the right load sprocket 23 which hands them off to the respective gun bolts in the rotor. The rounds are fired and continue around until they are taken off by the unload sprocket 26 which in turn hands them off to the left conveyor elements as they pass the left turnaround sprocket. When the gun reverse-clears, the direction of the rotor, the center sprocket, and the left endless conveyor is reversed, and the rounds are taken off by the load sprocket 22 which in turn hands them off to the center sprocket 34, which in turn hands them off to the transfer sprocket 82, which in turn hands them off to the left conveyor elements as they pass the turnaround sprocket. The reverse clearing continues until the last live round B is past the transfer sprocket 82.

The operation of the guides 200, 202, 204 and 206 has been previously discussed. The arrangement and operation of the remaining guides which cooperate with the conveyor elements and the sprockets is conventional and may be found in the previously identified patents.

I claim:

1. A dual feeder for a gun having a housing and a rotor with a plurality of gun barrels and a like plurality of gun bolts, comprising:

a source of positive drive;

a first endless conveyor means, adapted to be driven positively by said positive drive source, for in-feeding a first train of rounds of ammunition;

a second endless conveyor means, adapted to be driven positively by said positive drive source, for in-feeding a second train of rounds of ammunition;

a third means including a sprocket having cutouts for receiving rounds passing towards the gun bolts and for receiving rounds passing from the gun bolts, driven positively by said positive drive source, for receiving and for placing onto the gun bolts rounds of ammunition in sequence;

a fourth means for coupling said first conveyor means to said positive drive source and to said third means for the positive feeding of rounds to said third means and for concurrently decoupling said second endless conveyor means, and for coupling said second endless conveyor means to said positive drive source and to said third means for the positve feeding of rounds to said third means and for concurrently decoupling said first endless conveyor means.

2. A dual feeder for a gun having a housing and a rotor with a plurality of gun barrels and a like plurality of gun bolts, comprising:

first means for supplying a first train of rounds of ammunition;

second means for supplying a second train of rounds of ammunition;

third means, including a sprocket having cutouts for receiving rounds passing towards the gun bolts and for receiving rounds passing from the gun bolts, for receiving and for storing and for passing to the gun bolts rounds of ammunition in sequence; and fourth means for coupling said first means to said third means for the passage of rounds thereto and for concurrently decoupling said second means, and for coupling said second means to said third means for the passage of rounds thereto and for concurrently decoupling said first means; wherein the gun rotor is adapted to rotate in a first direction for receiving and for firing rounds of ammunition and is adapted to rotate in a second, opposite to said first, direction for clearing the rotor of rounds of ammunition; and said third means serves for receiving cleared rounds from the gun bolts and for storing and passing rounds of ammunition in sequence to whichever of said first or second means is coupled thereto by said fourth means.

3. A dual feeder for a gun having a housing and a rotor with a plurality of gun barrels and a like plurality of gun bolts, comprising:

first means for supplying a first train of rounds of ammunition;

second means for supplying a second train of rounds of ammunition;

third means for receiving and for storing and for passing to the gun bolts rounds of ammunition in sequence; and fourth means for coupling said first means to said third means for the passage of rounds thereto and for concurrently decoupling said second means, and for coupling said second means to said third means for the passage of rounds thereto and for concurrently decoupling said first means;

said first means including a first sprocket means and a first additional sprocket means;

said second means including a second sprocket means and a second additional sprocket means;

said third means including a third sprocket means, a third first additional sprocket means and a third second additional sprocket means;

said third first additional sprocket means serving to pass rounds bidirectionally between said first sprocket means and said third sprocket means and bidirectionally between said third sprocket means and said gun bolts;

said third second additional sprocket means serving to pass rounds bidirectionally between said second sprocket means and said third sprocket means and bidirectionally between said third sprocket means and said gun bolts;

said first additional sprocket means serving to pass rounds bidirectionally between said first sprocket means and said third sprocket means; and said second additional sprocket means serving to pass rounds bidirectionally between said second sprocket means and said third sprocket means.

4. A feeder according to claim 3 wherein:

said first sprocket means includes a first endless conveyor for rounds; and said second sprocket means includes a second endless conveyor for rounds.

5. A feeder according to claim 4 wherein:

said feeder has four alternative paths of travel:

1. from said first endless conveyor, to said third first additional sprocket means, to said third sprocket means, to said first additional sprocket means, to said gun bolts, to said third second additional sprocket means, to said third sprocket means, to said first additional sprocket means, to said first endless conveyor;
2. the reverse of path 1 above;
3. from said second endless conveyor, to said second additional sprocket means, to said third sprocket means, to said first additional sprocket means, to said gun bolts, to said third second additional sprocket means, to said third sprocket means, to said third second additional sprocket means, to said second endless conveyor; and 4. The reverse of path 3 above.

6. A feeder according to claim 4 wherein:

said fourth means serves to alternatively couple:

1. said first endless conveyor to said third first additional sprocket means and said first additional sprocket means to said third sprocket means; or
2. said second endless conveyor to said third second additional sprocket means and said second additional sprocket means to said third sprocket means.

7. A feeder according to claim 6 wherein:

said fourth means includes first guide means having two alternative configurations:

a first configuration for guiding rounds from said first endless conveyor into said third sprocket means and out from said third sprocket means to said first endless conveyor; and a second configuration for guiding rounds within said third sprocket means; and second guide means having two alternative configurations:

a first configuration for guiding rounds from said second endless conveyor into said third sprocket means and out from said third sprocket means to said second endless conveyor; and a second configuration for guiding rounds within said third sprocket means;

said first guide means being in its first configuration when said second guide means is in its second configuration; and said second guide means being in its first configuration when said first guide means is in its second configuration.

8. A feeder according to claim 7 wherein:

said first and second guide means each includes a respective pair of arms intercoupled in a toggle, wherein said arms are folded back in said respective first configuration and extended outwardly in said respective second configuration.

9. A weapon system comprising:

a gun having a housing and a rotor having a plurality of gun barrels and a like plurality of gun bolts, and adapted to rotate in a first direction and, alternatively, in a second direction opposite to said first direction;

a feeder comprising:

a first endless conveyor means, adapted to be driven positively by said rotor for in-feeding a first train of rounds of ammunition;

a second endless conveyor means, adapted to be driven positively by said rotor for in-feeding a second train of rounds of ammunition;

third means including a sprocket having cutouts for receiving rounds passing towards the gun bolts and for receiving rounds passing from the gun bolts, driven positively by said rotor, for receiving and for placing onto the gun bolts rounds of ammunition in sequence, during rotation of the rotor in said first direction and for receiving rounds from the gun bolts during rotation of the rotor in said second direction;

fourth means for coupling said first conveyor means to said rotor and to said third means for the positive feeding of rounds to and from said third means and for concurrently decoupling said second endless conveyor means, and for coupling said second conveyor means to said rotor and to said third means for the positive feeding of rounds to and from said third means and for concurrently decoupling said first endless conveyor means.

10. A weapon system comprising:

a gun having a housing and a rotor having a plurality of gun barrels and a like plurality of gun bolts; and a feeder having first means for supplying a second train of rounds of ammunition;

second means for supplying a second train of rounds of ammunition;

third means, including a sprocket having cutouts for receiving rounds passing towards the gun bolts and for receiving rounds passing from the gun bolts, for receiving and for storing and for passing to said gun bolts rounds of ammunition in sequence; and fourth means for coupling said first means to said third means for the passage of rounds thereto and for concurrently decoupling said second means, and for coupling said second means to said third means for the passage of rounds thereto and for concurrently decoupling said first means; wherein said gun rotor rotates in a first direction for receiving and for firing rounds of ammunition and rotates in a second, opposite to said first, direction for clearing said rotor of rounds of ammunition; and said third means serves for receiving cleared rounds from said gun bolts and for storing and passing rounds of ammunition in sequence to whichever of said first or second means is coupled thereto by said fourth means.

11. A weapon system comprising:

a gun having a housing and a rotor having a plurality of gun barrels and a like plurality of gun bolts; and a feeder having first means for supplying a first train of rounds of ammunition;

second means for supplying a second train of rounds of ammunition;

third means for receiving and for storing and for passing to said gun bolts rounds of ammunition in sequence; and fourth means for coupling said first means to said third means for the passage of rounds thereto and for concurrently decoupling said second means, and for coupling said second means to said third means for the passage of rounds thereto and for concurrently decoupling said first means;

said first means includes a first sprocket means and a first additional sprocket means;

said second means includes a second sprocket means and a second additional sprocket means;

said third means includes a third sprocket means, a third first additional sprocket means and a third second additional sprocket means;

said third first additional sprocket means serving to pass rounds bidirectionally between said first sprocket means and said third sprocket means and bidirectionally between said third sprocket means and said gun bolts;

said third second additional sprocket means serving to pass rounds bidirectionally between said second sprocket means and said third sprocket means and bidirectionally between said third sprocket means and said gun bolts;

said first additional sprocket means serving to pass rounds bidirectionally between said first sprocket means and said third sprocket means; and said second additional sprocket means serving to pass rounds bidirectionally between said second sprocket means and said third sprocket means.

12. A feeder according to claim 11 wherein:

said first sprocket means includes a first endless conveyor for rounds; and said second sprocket means includes a second endless conveyor for rounds.

13. A feeder according to claim 12 wherein:

said feeder has four alternative paths of travel:

1. from said first endless conveyor, to said third first additional sprocket means, to said third sprocket means, to said first additional sprocket means, to said gun bolts, to said third second additional sprocket means, to said third sprocket means, to said first additional sprocket means, to said first endless conveyor;
2. the reverse of path 1 above;
3. from said second endless conveyor, to said second additional sprocket means, to said third sprocket means, to said first additional sprocket means, to said gun bolts, to said third second additional sprocket means, to said third sprocket means, to said third second additional sprocket means, to said second endless conveyor; and
4. the reverse of path 3 above.

14. A feeder according to claim 12 wherein:

said fourth means serves to alternatively couple:

1. said first endless conveyor to said third first additional sprocket means and said first additional sprocket means to said third sprocket means; or
2. said second endless conveyor to said third second additional sprocket means and said second additional sprocket means to said third sprocket means.

15. A feeder according to claim 14 wherein:

said fourth means includes first guide means having two alternative configurations:

a first configuration for guiding rounds from said first endless conveyor into said third sprocket means and out from said third sprocket means to said first endless conveyor; and a second configuration for guiding rounds within said third sprocket means; and second guide means having two alternative configurations:

a first configuration for guiding rounds from said second endless conveyor into said third sprocket means and out from said third sprocket means to said second endless conveyor; and a second configuration for guiding rounds within said third sprocket means;

said first guide means being in its first configuration when said second guide means is in its second configuration; and said second guide means being in its first configuration when said first guide means is in its second configuration.

16. A feeder according to claim 15 wherein:

said first and second guide means each includes a respective pair of arms intercoupled in a toggle, wherein said arms are folded back in said respective first configuration and extended outwardly in said respective second configuration.

* * * * *